US007194865B2

(12) United States Patent
Drob

(10) Patent No.: US 7,194,865 B2
(45) Date of Patent: Mar. 27, 2007

(54) TURBINE OVERSPEED PROTECTION

(75) Inventor: Dmitry Drob, West Des Moines, IA (US)

(73) Assignee: Compressor Controls Corporation, Des Moines, IA (US)

( * ) Notice: Subject to any disclaimer, the term of this patent is extended or adjusted under 35 U.S.C. 154(b) by 304 days.

(21) Appl. No.: 10/930,495

(22) Filed: Aug. 30, 2004

(65) Prior Publication Data

US 2006/0042265 A1 Mar. 2, 2006

(51) Int. Cl.
*F02C 9/28* (2006.01)
*F01D 17/06* (2006.01)

(52) U.S. Cl. ..... 60/779; 60/39.281; 415/1; 415/43

(58) Field of Classification Search ..... 60/39.091, 60/39.281, 779; 415/1, 36, 41, 42, 43
See application file for complete search history.

(56) References Cited

U.S. PATENT DOCUMENTS 1,961,813 A * 6/1934 Caughey ..... 415/42
2,386,110 A 10/1945 Hagemann
2,595,007 A 4/1952 Sheppard
2,926,680 A * 3/1960 Eggenberger ..... 415/43
3,614,457 A * 10/1971 Eggenberger ..... 290/40 R
3,685,791 A 8/1972 Czuszak
4,208,032 A 6/1980 Mineur

* cited by examiner

*Primary Examiner*—L. J. Casaregola
(74) *Attorney, Agent, or Firm*—Sturm & Fix LLP

(57) ABSTRACT

A method and apparatus for turbine overspeed protection, useful for steam and gas turbines, is disclosed. The apparatus comprises a spring-loaded rod held by a plurality of energized solenoids in an operating position any time the turbine's shaft rotational speed is less than a trip rotational speed set-point. When the rotational speed reaches the trip rotational speed set-point, both solenoids are de-energized and the spring-loaded rod moves to provide turbine trip. Increased reliability of the solenoids is provided by compressing the spring during the resetting of the rod with an additional electromechanical actuator and by using a plurality of solenoids, each of which is able to provide the force required to hold the spring in its compressed state.

7 Claims, 2 Drawing Sheets

TURBINE OVERSPEED PROTECTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

This invention relates to overspeed protection. In particular, this invention relates to a method and apparatus for overspeed protection of a gas or steam turbine driving an electrical generator or other load from which the power consumed may rapidly drop.

2. Background Art

Generator breaker opening and other forms of rapid generator unloading can result in very high turbine shaft acceleration. Typically, a turbine will have a general speed control system, providing startup features and is made to maintain the turbine in continuous operation. Such a control system may or may not have an overspeed protection function. In addition, the turbine also typically has a dedicated overspeed protection system. When the speed control system does not operate properly, or when an upset occurs outside the ability of the speed control system to control, only the turbine overspeed protection system can prevent damage to the turbine and turbine shaft.

Traditionally, dedicated overspeed protection for gas and steam turbines was usually provided by a spring-loaded eccentric bolt (installed inside the turbine shaft) or a spring-loaded piston (installed outside the turbine shaft). Under high rotational speed conditions, either of these mechanisms was forced by centrifugal force to strike a lever providing a trip by closing the governor valves and trip valve(s), resulting in a turbine overspeed trip. Due to friction and wear, often an eccentric bolt does not work precisely and reliably. As a result, these bolts are now often replaced by an electronic overspeed trip device with electrical output acting on the lever or a spring-loaded rod or the valve itself.

The usual configuration for an electronic overspeed trip device comprises a solenoid valve which restrains the spring-loaded rod or valve when it is energized. Under normal turbine loading, this solenoid is energized. If the turbine experiences a high rotational speed, the solenoid is de-energized by the electronic overspeed trip device and the turbine trips and decelerates, perhaps shutting down entirely. Such an episode may occur immediately after an opening of the generator breaker or rapid generator unloading. A disadvantage of this solution is the high solenoid current required for spring compression for resetting the rod or valve decreases the reliability of the electronic overspeed trip device circuitry.

An unreliable solenoid power supply circuit may be the cause of false turbine trips due to insufficient current from the power supply.

BRIEF SUMMARY OF THE INVENTION

An object of this invention is the increased reliability of control of a solenoid restraining a spring-loaded rod or valve upon an overspeed event of a gas or steam turbine. This object is achieved by compressing a spring, usually compressed by the solenoid, during a reset in order to provide reduce the load the solenoid is under, thus reducing the solenoid current and eliminating the need for additional relays. The spring compression is provided by an electromechanical device which is not electrically connected with the overspeed protection circuit.

In particular, the electromechanical device compresses the spring, thereby unloading the solenoid before and during reset, and decompresses the spring, reloading the solenoid after reset.

These steps, provided by an electromechanical actuator and associated lever, are not otherwise part of the turbine overspeed protection. In other words, the electromechanical device only comes to bear during a reset after an overspeed trip event.

With the additional electromechanical device carrying out the above steps, high current is not required for the solenoid to reset the spring-loaded rod or valve, yet the solenoid still provides the necessary high force to hold the spring-loaded rod or valve until an overspeed event occurs.

In addition, the reliability of the overspeed protection system is further improved by the use of two solenoids, each of which providing sufficient force to hold the rod or valve in its operating position.

DETAILED DESCRIPTION OF THE INVENTION

Figure 1:
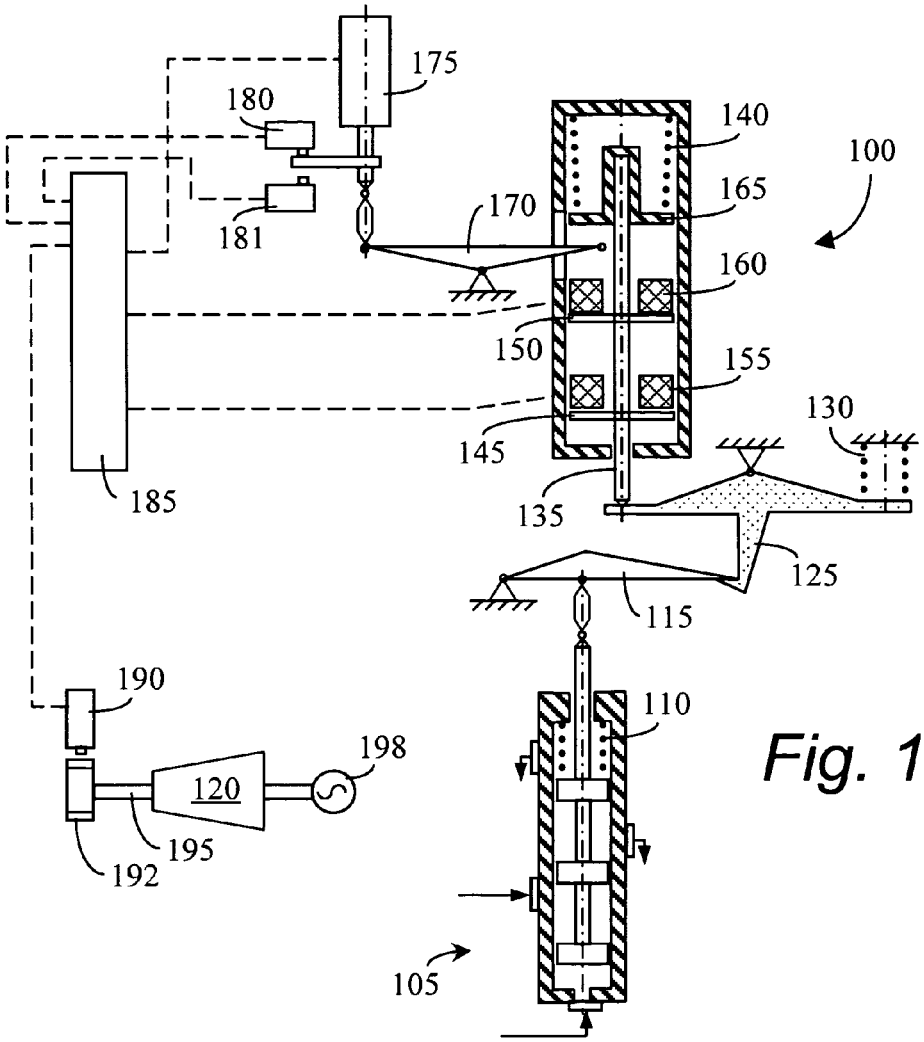
FIG. 1 is a schematic of a turbine overspeed protection electromechanical subsystem of an automatic turbine control system.

The turbine overspeed protection electro-mechanic subsystem of a turbine automatic control system is shown on FIG. 1. The overspeed system shown in FIG. 1 is shown in schematic form. Therefore, the orientation, that is, up and down and left and right, of the components in FIG. 1 is not necessarily representative of an actual installation. However, it will be useful to refer to the orientation of FIG. 1 in this specification.

Here a trip pilot valve 105 loaded by a spring 110 is connected with a trip lever 115 restrained (while the turbine 120 is loaded normally) by a hook on a protection lever 125. Hydraulic connections of the trip pilot valve 105 with a hydraulic resetting device and with stop and governor valve actuators are not shown. The protection lever 125 is loaded by a protection lever spring 130.

Engaging an end of the protection lever 125 opposite the protection lever spring 130, is a spring-loaded rod 135 within a solenoid trip assembly 100. A trip spring 140 applies force to the spring-loaded rod 135 in a downward direction according to the orientation of FIG. 1. Plates 145, 150 are fastened to the rod 135 and function to anchor two solenoids 155, 160. The present invention is not limited to a specific number of solenoids 155, 160. A plurality of solenoids 155, 160 provide greater reliability than a single solenoid since each solenoid 155, 160 can provide adequate force to hold the trip spring 140 in compression. A sliding plate 165 engaged by the trip spring 140 can be forced upward (in the orientation of FIG. 1), by an auxiliary lever 170. The auxiliary lever 170 is actuated by an electromechanical actuator 175 which is equipped with limit switches 180, 181.

The solenoids 155, 160 and the electromechanical actuator 175 are under the governance of a controller 185. The controller 185 utilizes a signal from at least one (typically three) speed sensor such as a Magnetic Pickup Unit (MPU) 190 activated by a gear 192 turning on a turbine shaft 195 on which the electric generator 198 is installed.

The turbine overspeed protection electromechanical subsystem operates as follows.

Figure 4:
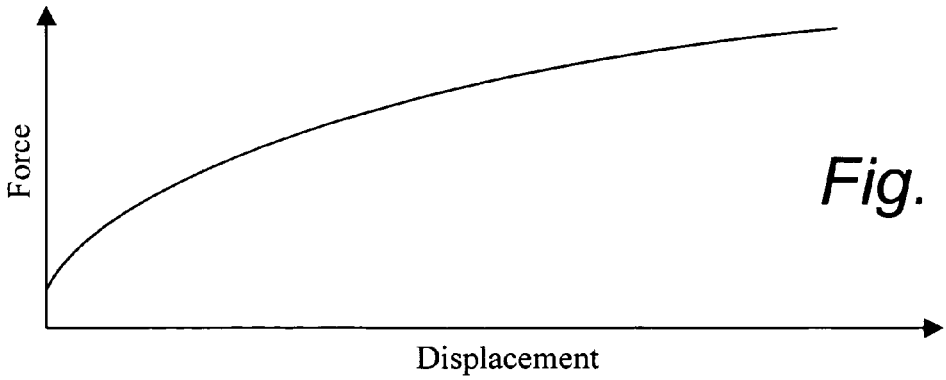
FIG. 4 is a force-displacement plot for a solenoid.

Before turbine startup, the electromechanical actuator 175 actuates the auxiliary lever 170. The auxiliary lever 170 engages the sliding plate 165 and forces it against the spring to its high limit position. The achievement of the high limit position is sensed by the limit switch 181 and a signal to this effect is sent to the controller 185. Thus, the force of the spring 140 is removed from the rod 135. When the sliding plate 165 reaches its high limit position, the controller 185 energizes the solenoids 155, 160, and they move the rod 135 to its upper position. As illustrated in FIG. 4, the force-displacement characteristics of the solenoids 155, 160 are such that, when the rod 135 is in its upper position, the force exerted by the solenoids 155, 160 to the rod 135 is significantly greater than when the rod 135 is in a lower position.

With the rod 135 in its upper position, the electromechanical actuator 175 relaxes, permitting the sliding plate 165 to return to its lowered position. Upon reaching this lowered position, the lower limit switch 180 sends a signal to the controller 185. By returning the sliding plate 165 to its lowered position, spring force is returned to the rod 135 from the spring 140. In this state, the spring-loaded rod 135 is in position to provide a turbine trip effected by de-energizing the solenoids 155, 160 and permitting the spring-loaded rod 135 to engage the protection lever 125.

Once the solenoids 155, 160 are holding the spring 140 in compression, the trip pilot valve 105 is moved to its top limit via hydraulic pressure upon a hydraulic reset signal from the hydraulic reset device (not shown). The trip lever 115 is raised by the trip pilot valve 105 during this action. Once the trip lever 115 is engaged to the protection lever 125, the hydraulic reset signal ceases. In this position, the stop and governor valves may be manipulated by their actuators.

The turbine 120 is now prepared for startup. Under normal turbine load, the controller 185 monitors the turbine's 120 rotational speed by the at least one speed MPU 190 activated by the gear 192. The controller 185 controls the turbine's 120 speed and/or droop.

However, should the rotational speed reach its trip set point, the controller 185 will de-energize the solenoids 155, 160. With the solenoids 155, 160 de-energized, the spring-loaded rod 135 is forced downward by the spring 140 to a lower position where the spring-loaded rod 135 engages the protection lever 125, forcing one end of the protection lever 125 downward in the orientation of FIG. 1. This action releases the trip lever 115 from its captive position hooked on the protection lever 125. When the trip pilot valve 105 is released along with the trip lever 115, the spring 110 forces the trip pilot valve 105 to its lower position, causing the closing of the stop and governor valves via their actuators controlled by the trip pilot valve 105. Thus the turbine 120 no longer has energy input and is permitted to shut down.

Each solenoid 155, 160 is sized to provide sufficient force, alone, to maintain the spring 140 in its compressed state. Therefore, failure of either solenoid 155, 160, singly, will not result in a false trip of the turbine 120.

Figure 2:
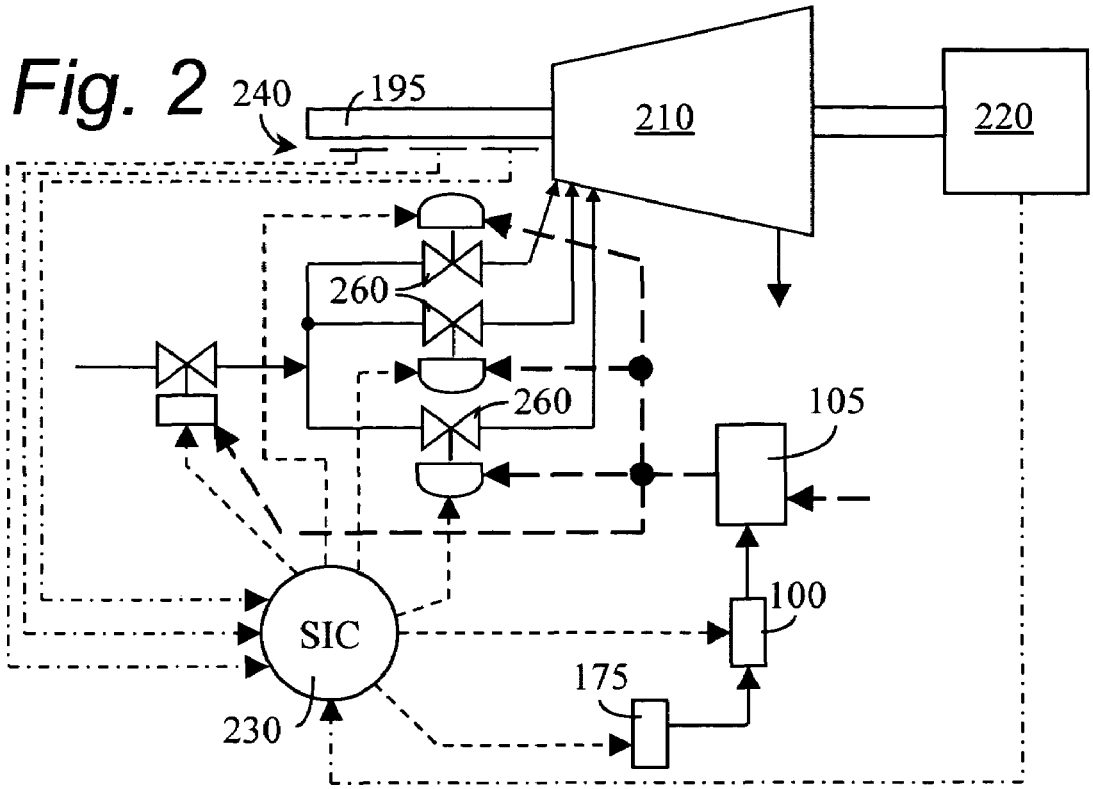
FIG. 2 is a schematic of a steam turbine and steam turbine control system.
Figure 3:
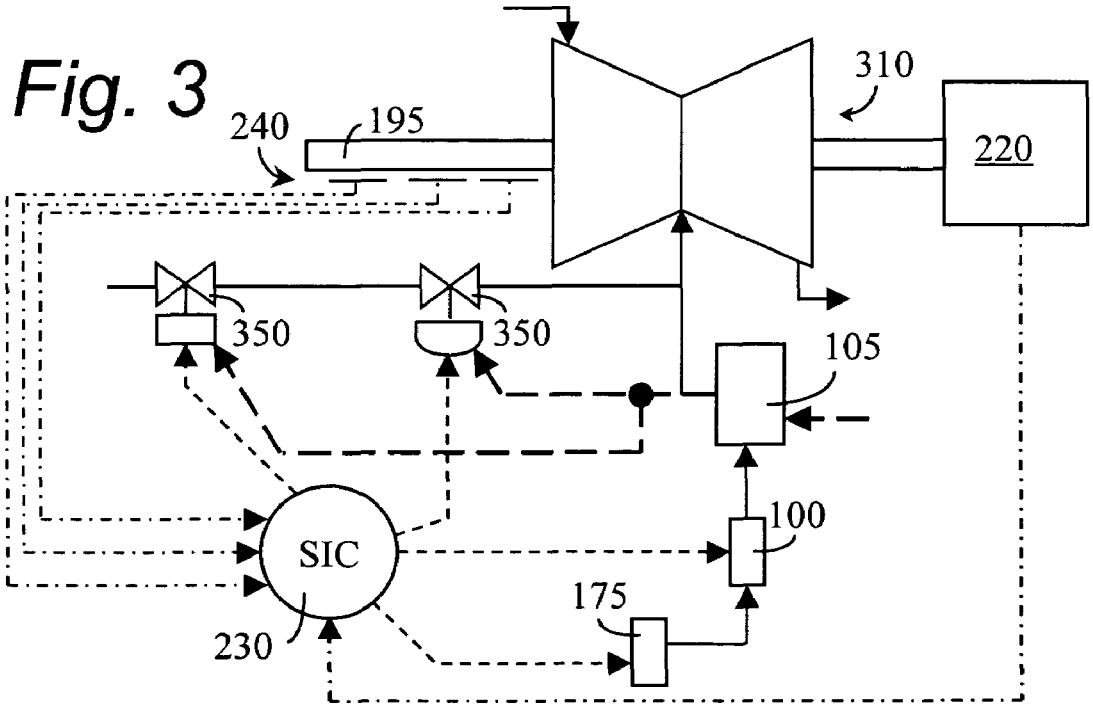
FIG. 3 is a schematic of a gas turbine and gas turbine control system.

FIGS. 2 and 3 show how the present invention fits into a steam turbine control system and a gas turbine control system, respectively.

In FIG. 2, a steam turbine 210 is shown driving a load 220. Examples of loads 220 driven by steam turbines 210 are generators 198, compressors, and pumps. This invention is not limited to a particular load 220. The load 220 may include a monitoring and/or control system for that load 220.

A speed controller 230 may comprise one or more separate components. The speed controller's 230 functions may include any of the following:

1. Startup sequencing.
2. Turbine rotational speed control.
3. Generator droop control.
4. Overspeed protection.
5. Emergency shutdown.

As input signals, the speed controller 230 receives information from at least one rotational speed sensor 240 such as an MPU. Preferably, a plurality of said rotational speed sensors 240 are utilized for additional reliability. In a typical installation, three such rotational speed sensors 240 are found. Additional input signals may include information about the load 220 such as a status of a generator breaker or an indication of surge in a compressor. Valve position signals may be fed back into the speed controller 230, and other signals, typically found in turbine installations, may also be received by the speed controller 230. With the information received as inputs, the speed controller 230 manipulates a trip and throttle valve 250 and a throttling valve or a steam rack 260 used for metering a steam flow rate through the steam turbine 210 for governing purposes. An overspeed function within the speed controller 210 system also controls the electromechanical actuator 175 for resetting the spring-loaded rod 135 and the solenoids 155, 160 within the solenoid assembly 100. The solid arrows between the electromechanical actuator 175, solenoid assembly 100 and the trip pilot valve 105 represent the mechanical interactions of the auxiliary lever 170, protection lever 125, and trip lever 115.

Hydraulic fluid, shown as heavy, long dashed lines, passes through the trip pilot valve 105 before passing through individual pilot valves for the actuator manipulating the trip and throttle valve 250 and the throttling valve or steam rack 260. In this way, if the trip pilot valve 105 is in its tripped position, the actuators for the trip and throttle valve 250 and the throttling valve or steam rack 260 will cause these valves to close, causing the steam turbine 210 to shut down.

A corresponding system for a gas turbine 310 is shown in FIG. 3. The load 220, potentially with its control and/or monitoring system, is shown being driven off the turbine shaft 195.

The fuel is metered into the gas turbine 310 through one or more fuel valves 350, 360. The positions of these fuel valves 350, 360 are specified by the speed controller 230. The actuators for the fuel valves 350, 360 are charged with hydraulic fluid that passes through the trip pilot valve 105. Again, if the trip pilot valve 105 is in its tripped position, the actuators for the fuel valves 350, 360 will cause these valves to close, causing the gas turbine 310 to shut down.

The above embodiment is the preferred embodiment, but this invention is not limited thereto. It is, therefore, apparent that many modifications and variations of the present invention are possible in light of the above teachings. Hence, it is to be understood that within the scope of the appended claims, the invention may be practiced otherwise than as specifically described.

I claim:

1. A method of turbine overspeed protection wherein a turbine overspeed protection system comprises a spring-loaded rod, loaded by a force derived from a spring, said spring being restrained by the rod in a reset position due to at least one solenoid when a rotational speed of a turbine is less than a predetermined maximum, said turbine overspeed protection system providing a hydraulic pilot valve trip action when said turbine rotational speed exceeds said predetermined maximum, the method comprising the steps of:

(a) reducing the force due to the spring on the spring-loaded rod when resetting the turbine overspeed protection system;

(b) energizing the at least one solenoid after reducing said force, thus positioning the spring-loaded rod in its reset position; and (c) reapplying said force due to the spring to the spring-loaded rod after energizing the solenoid.

2. The method of claim 1 wherein the step of reducing the force due to the spring comprises compressing the spring.

3. The method of claim 1 wherein the step of reducing the force due to the spring comprises actuating an electromechanical actuator, said electromechanical actuator operatively bearing on said spring wherein said actuation reduces the force due to said spring on the spring-loaded rod.

4. The method of claim 1 wherein the step of reducing the force due to the spring comprises:

(a) operatively connecting an auxiliary lever to a pivot point;

(b) operatively connecting an electromechanical actuator to said auxiliary lever;

(c) operatively engaging the spring with said auxiliary lever; and (d) actuating said electromechanical actuator, thereby reducing the force due to the spring on the spring-loaded rod.

5. The method of claim 1 wherein the turbine overspeed protection is for overspeed protection of a steam turbine.

6. The method of claim 1 wherein the turbine overspeed protection is for overspeed protection of a gas turbine.

7. The method of claim 1 wherein the step of reducing the force due to the spring comprises removing all force due to the spring on the spring-loaded rod.

* * * * *